US006558064B1

(12) United States Patent
Tibbetts

(10) Patent No.: US 6,558,064 B1
(45) Date of Patent: May 6, 2003

(54) RING BINDER SHEET POSITIONER

(75) Inventor: Paul R. Tibbetts, Palmer, MA (US)

(73) Assignee: Specialty Loose Leaf, Inc., Holyoke, MA (US)

( * ) Notice: Subject to any disclaimer, the term of this patent is extended or adjusted under 35 U.S.C. 154(b) by 0 days.

(21) Appl. No.: 09/663,276

(22) Filed: Sep. 18, 2000

Related U.S. Application Data

(60) Provisional application No. 60/161,590, filed on Oct. 26, 1999, and provisional application No. 60/179,786, filed on Feb. 2, 2000.

(51) Int. Cl.[7] ..... B42F 3/04; B42F 13/00; B42F 13/16

(52) U.S. Cl. ..... 402/80 R; 402/80 P; 402/80 R

(58) Field of Search ..... 402/80 L, 80 P, 402/80 R

(56) References Cited

U.S. PATENT DOCUMENTS

| | | | | |
|---|---|---|---|---|
| 2,179,986 A | | 11/1939 | Trussell | |
| 2,505,694 A | | 4/1950 | Stuercke | |
| 3,191,604 A | | 6/1965 | Wance | |
| 3,306,301 A | | 2/1967 | Mason | |
| 3,366,118 A | | 1/1968 | Beyer | |
| 3,591,300 A | | 7/1971 | Beyer | |
| 3,910,708 A | * | 10/1975 | Rohner | 402/80 L |
| 4,185,934 A | | 1/1980 | Hodson | |
| 4,573,822 A | | 3/1986 | Allen | |
| 4,784,507 A | * | 11/1988 | Vetter | 281/15.1 |
| 5,503,489 A | | 4/1996 | Maudal | |
| 5,549,406 A | | 8/1996 | Cohen | |
| 6,200,058 B1 | * | 3/2001 | Maudal | 402/80 L |

* cited by examiner

*Primary Examiner*—A. L. Wellington
*Assistant Examiner*—Mark Henderson
(74) *Attorney, Agent, or Firm*—Robert A. Seemann

(57) ABSTRACT

A springy panel bridges the ring mechanism housing. It is mounted on the ring halves so that when the ring halves close they cam the panel up the lower curve of the segments, and bow the panel upward away from the ring mechanism housing cover. An element having an upward end cam surface for paper or for a sheet lifter is mounted through two holes in the element on a lower segment of a ring so that one end of the element is inside the ring adjacent to the ring mechanism cover, the other end is inside the ring, adjacent to a line through the widest horizontal portion of the closed ring, and the element bows out of the ring between the two ends.

17 Claims, 9 Drawing Sheets

RING BINDER SHEET POSITIONER

This application claims the benefit of U.S. Provisional Application No. 60/161,590, filed Oct. 26, 1999, and U.S. Provisional Application No. 60/179,786, filed Feb. 2, 2000.

BACKGROUND OF THE INVENTION

1. Field of the Invention

The invention pertains to the art of binder devices which releasably engage apertures in sheets, more specifically to attachments to the rings that move the sheets out from between the lateral tangency of the cover of the binder with the ring when the cover is closed to the ring.

2. Description of the Prior Art

It is a problem in ring binders that paper slides around to the backside or lower portion of the ring when the binder or book is opened. Then, when the binder is closed, the paper is trapped behind the lower portion of the ring, and between the ring and the cover by the cover against the ring, wherein the paper gets mangled and has to be dragged around to the front side of the ring.

The problem occurs with circular rings and is more severe with trapezoidal rings.

The patented art is replete with designs for preventing sheets from being trapped below and within the tangency between the ring and the closed cover. They are generally called "sheet lifters", sometimes "sheet guides" or "paper lifters".

One widely used sheet lifter prior art design which is shown and described herein, is a stiff, flat or slightly curved plate having holes along one side adjacent to the edge of the sheet.

The sheet lifter is made of poly, fiber, or plastic and is generally used in ring capacities over 1 ½" on binders where the rings' mechanism is on the spine of the binder, and where the ring mechanism is on a cover of the binder. It is also used on binder rings having less than 1½" capacity.

In FIG. 1, Prior Art sheet lifter 30 is mounted on rings 31 of binder 32. Sheet lifter 30 lays against ring mechanism housing 32 inside the rings, and lays against one of the binder covers 33 outside the rings. When the cover is rotated upward, lifted toward the rings, sheet lifter 30 slides upward 34 on each of the rings and lifts paper sheets, say loose-leaf paper (not shown), that is mounted on the rings. Sometimes edges 35 of the outer sides of ring receiving openings 36 in the sheet lifter catch under the lower portion 37 of the ring which is below the widest horizontal level 38 of the ring and prevent the lifter from moving the paper out of entrapment between the ring and the cover.

U.S. Pat. No. 3,191,604 patented Jun. 29, 1965 by F. Wance describes a wire wing that is hingedly attached to opposite ends of the ring mechansim longitudinal shell. The center of the wing loops back around one of the rings. When the cover is folded upward, toward the ring, the wing lifts the inner end of sheets that are mounted on the rings as the wing is lifted on the hinge axis by the cover. In one arrangement, a paper-end rest shoe containing a hole through which the ring passes, is mounted on the looped back portion of the wing.

U.S. Pat. No. 3,306,301 patented Feb. 28, 1967 by R. S. Mason describes a channel fastened along the center of the shield plate housing for the ring opening and closing movement or ring mechanism, having bottom hinged vertical walls hinged at their tops to laterally extending wings that are mounted near their inner ends on the rings. Closing the covers of the binder lifts the distal ends of the wings which move upward on the rings carrying the sheets upward on the ring with them.

U.S. Pat. No. 3,591,300 patented Jul. 6, 1971 by L. R. Beyer describes a pair of wings extending from a corrugated central hinge portion that spans the width of the ring mechanism housing, the inward end of each wing receiving an arm of the ring therethrough and having a pair of raised ribs that straddle the arm of the ring and are inclined downward toward the distal end of the wing so that they push ring-held sheets upward on the ring arm when the cover of the binder is moved upward toward the ring.

U.S. Pat. No. 3,366,118 patented Jan. 30, 1968 by L. R. Beyer describes a laterally extending wing receiving a plurality of the arms of the same side of the rings of the binder through an inward end of the wing, a pair of raised ribs straddling each arm, each pair being inclined downward toward the distal end of the wing so that they push ring-held sheets upward on the ring arm when the cover of the binder is moved upward toward the ring.

U.S. Pat. No. 4,185,934 patented Jan. 29, 1980 by H. C. Hodson describes a pair of laterally extending wings having a longitudinal broken slit creased to form a hinge, straddled by radial slits for receiving left and right arms of a plurality of rings of a ring binder. In one arrangment a longitudinal bar that is wide enough to center the hinge between the rings is fastened to the hinge.

U.S. Pat. No. 4,573,822 patented Mar. 4, 1986 by D. K. Allen describes a first longitudinal strip fastened lengthwise to the top of the longitudinal housing of the ring mechanism, and in mirror image on each side of the first strip, a second longitudinal strip receiving one arcuate half of each ring of the ring binder, attached by a first hinge to the first strip and laterally attached by a second hinge to a third longitudinal strip which is laterally attached by a third hinge to a fourth longitudinal strip that is fastened to the cover of the binder so that when the cover is lifted toward the ring the second hinge rises upward as it folds so that it lifts sheets of paper on the ring half that are held by the rings.

U.S. Pat. No. 5,503,489 patented by I. Maudal on Apr. 2, 1996 describes a laterally extending wing having a downwardly open raised curve on the inner end of the wing, one arm of the binder ring passes through the curve in two places, once through a hole in the transition arc between the curve and the lateral extending portion of the wing, and again through a U-shaped slot that opens out to the inner edge of the wing so that when the binder cover is lifted toward the ring, and the transition arc moves up the ring arm carrying mounted sheets of paper with it, the inner edge slides across the cover of the ring mechanism and laterally moves onto and straddles the ring arm.

SUMMARY OF THE INVENTION

It is one object of the invention to provide a device that prevents bound sheets in a loose-leaf binder from being caught in the lower part of the ring at or below the tangency of the cover with the ring when the cover is closed.

It is another object that when a prior art sheet lifter is used, the invention also prevents the prior art sheet lifter from being caught in the lower part of the ring at or below the tangency of the cover with the ring when the cover is closed.

Other objects and advantages of the invention will become apparent to one reading the ensuing description.

A sheet positioner for supporting a sheet on a sheet binder ring comprising a first arcuate segment and a second arcuate segment movable away from the first arcuate segment for opening the ring for receiving a sheet on one of the first and second segments by a hole in the sheet, movable toward the first arcuate segment for closing the ring at a first junction, and a ring operating mechanism cover from which lower portions of the first and second segments protrude; includes a stiff generally planar plate, a first hole through the plate large enough to receive the first segment through the plate, a second hole through the plate large enough to receive the second segment through the plate, the second hole being spaced from the first hole so that the plate is moved toward the junction by the first and second segments by movement of the second segment toward the first segment when the plate is mounted on the ring, for moving a sheet toward the junction when a sheet is mounted on the positioner on the ring.

The second hole is spaced from the first hole so that the plate is cammed toward the junction by sliding on at least one of the first and second holes in the plate along at least one of the first and second segments when the second segment is moved toward the first segment for closing the ring.

The second hole is spaced from the first hole so that the plate is bowed toward the junction along a continuous arc from the first hole to the second hole by the first and second segments when the second segment is moved toward the first segment for closing the ring.

A loose-leaf binder ring assembly includes a first arcuate segment, a second arcuate segment movable away from the first arcuate segment for opening the ring for receiving a sheet on one of the first and second segments by a hole in the sheet, and movable toward the first arcuate segment for closing the ring at a first junction, a ring operating mechanism cover from which lower portions of the first and second segments protrude, a tube having a top, a bottom and a longitudinal opening through which the tube is mounted on a segment, mounted on at least one of the first and second segments between the cover and a line in the plane of the ring that extends through the widest horizontal portion of the closed ring. Preferably the top of the tube is approximately tangent to the line. The longitudinal opening extends laterally through a side of the tube, the tube being mountable on the ring by moving the tube laterally on to a segment through the opening.

A sheet positioner assembly for a sheet binder includes a first binder ring comprising a first arcuate segment, a second arcuate segment movable away from the first arcuate segment for opening the first ring for receiving a sheet on one of the first and second segments by a hole in the sheet, and movable toward the first arcuate segment for closing the ring at a first junction, a second ring parallel to and spaced from the first ring, comprising a third segment, a ring operating mechanism cover having a length, from which lower portions of the first, second and third segments protrude, a first line in the plane of the first ring that extends through the widest horizontal portion of the closed first ring, a first longitudinal wall, a second longitudinal wall a third wall connecting the first wall to the second wall forming a longitudinal channel, a first hole through the first wall, a second hole through the second wall, an axis through the first and second holes that is transverse to the longitudinal axis of the channel, each hole of the first and second holes being large enough to receive a segment of the first ring, the channel being on one of the first and second segments, the channel being elastic so that the first and second walls resile laterally so that the channel locks on the segment by the first and second holes when the channel is left unattended. The third wall and the connection of the third wall to the first and second walls is hingeless.

A loose-leaf binder ring assembly includes a first arcuate segment and a second arcuate segment movable away from the first arcuate segment for opening the ring for receiving a sheet on one of the first and second segments by a hole in the sheet, and movable toward the first arcuate segment for closing the ring at a first junction, a ring operating mechanism cover from which lower portions of the first and second segments protrude, a binder cover hingedly connected to the ring operating mechanism cover, a panel having a first end and a second end, comprising a first hole through the panel, a second hole through the panel, mounted on one of the lower portions by the portion through the holes so that when the ring is closed, the panel arcs from the first end being in the ring adjacent to the operating mechanism cover, to being outside the ring below a line in the plane of the ring that extends through the widest horizontal portion of the ring, to the second end being in the ring above the first end for pivoting a sheet on the second end when the sheet is mounted on the ring on the panel and the sheet is moved toward the junction by the binder cover. The second end is adjacent to the line.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
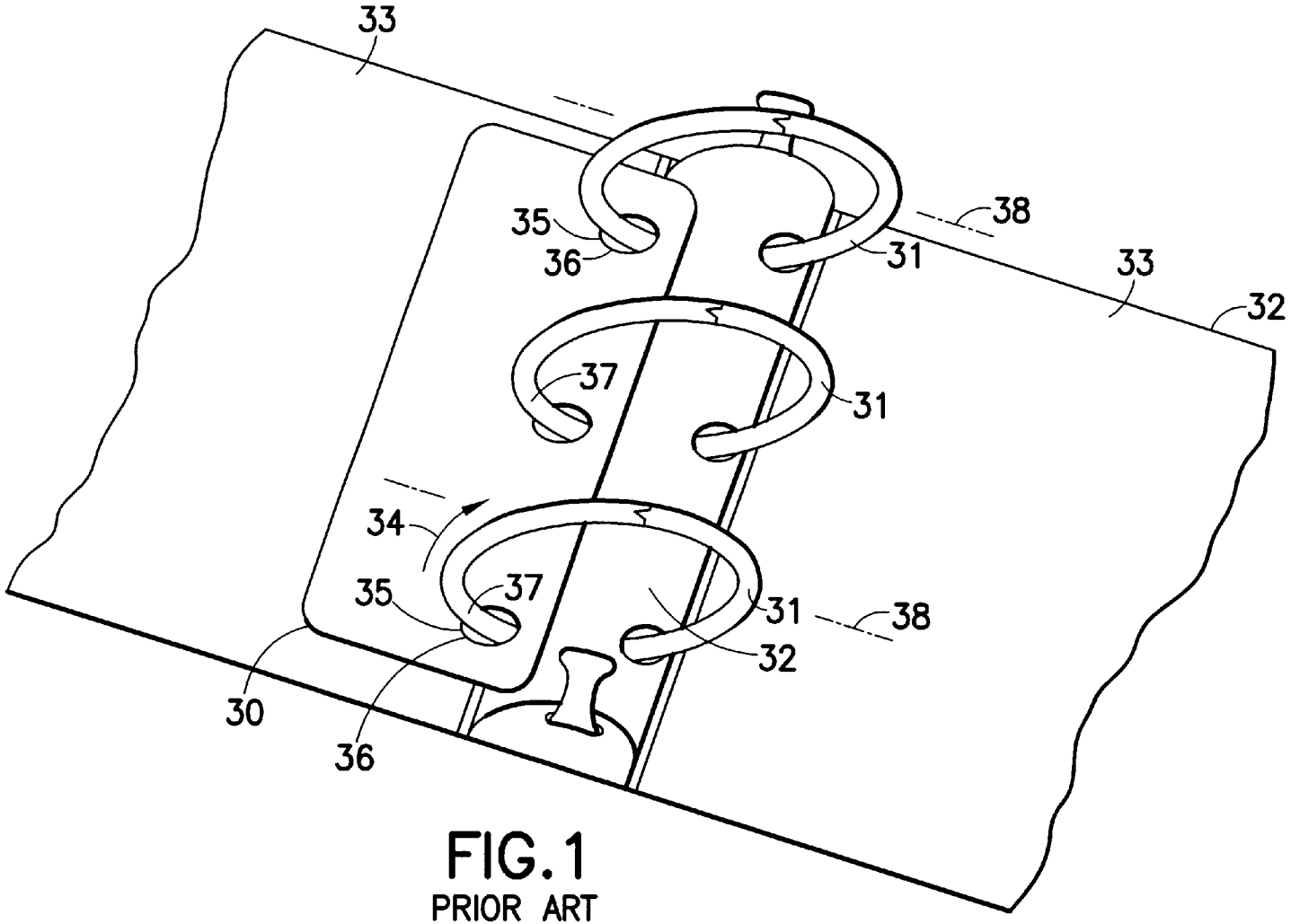
FIG. 1 PRIOR ART
FIG. 1 is a schematic top view of a PRIOR ART sheet lifter on a 3-ring binder.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 2–6, positioner 40 is mounted on lower portions 42, 43 of segments 44, 46 of binder ring 50. Binder ring 50 is trapezoidal.

Figure 2:
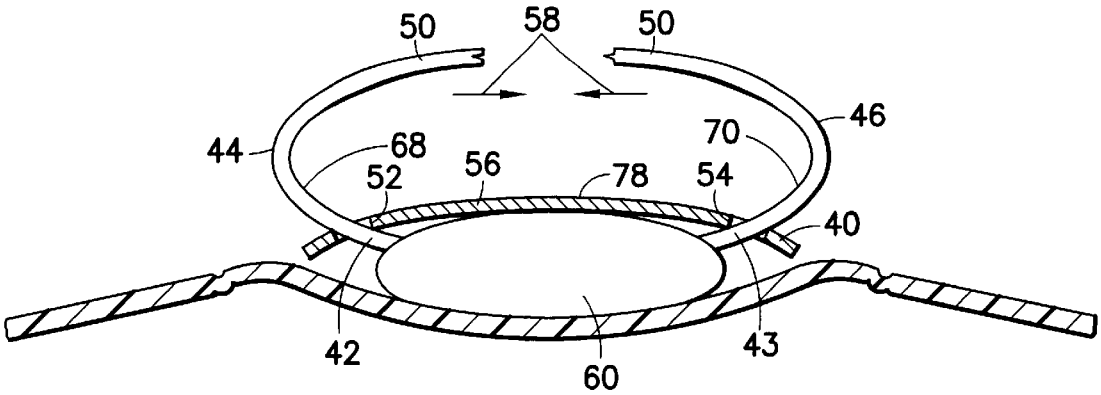
FIG. 2 is a schematic view of a positioner shown in cross section, mounted on an open trapezoidal ring of a ring binder.

In FIG. 2, the ring is open, the segments are separated. Positioner 40 holes 52, 54 are positioned on plate 56 so that the plate is adjacent to housing 60 and is preferably in contact with housing 60 when the segments are separated. Housing 60 contains the operating mechanism for the ring.

Figure 3:
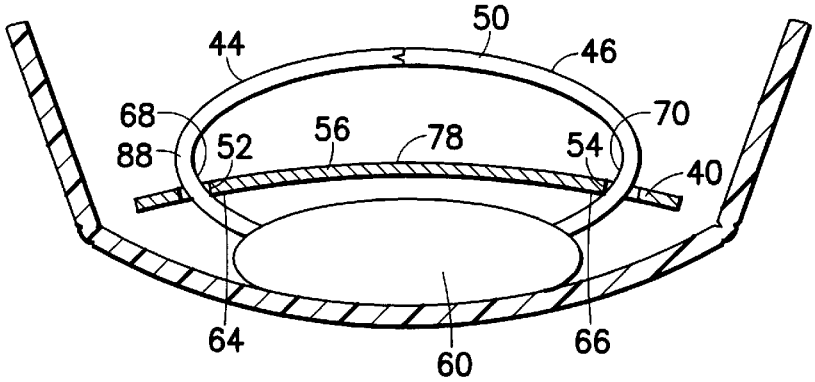
FIG. 3 is a schematic view of the positioner and the closed ring of FIG. 2.
Figure 4:
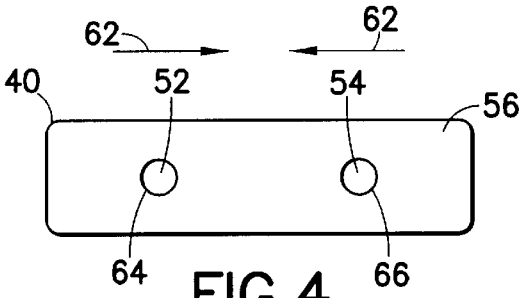
FIG. 4 is a top view of the positioner of FIG. 2.
Figure 5:
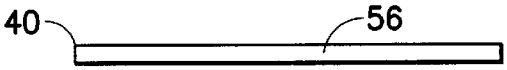
FIG. 5 is a front view of the positioner of FIG. 2.

In FIG. 3, the segments are closed. Positioner 40 holes are shaped and spaced from one another such that the positioner is lifted by the curved portions of the lower portions as the lower portions move upward and toward one another as the ring.

Positioner 40 is stiff enough so that when holes 52, 54 inward 62 sections 64, 66 are in contact with concave arcuate surfaces 68, 70 of segments 44, 46 so that the inward sections are cammed upward by the upwardly and inwardly 58 moving lower portions 42, 43. Preferably positioner 40 is resilient enough, and holes 40 are spaced from each other a distance such that center portion 78 of positioner 40 bowes or bends up springly in response to the inward force of the inward moving ring segments 44, 46. The raised positioner keeps sheets which can include loose-leaf paper and a sheet lifter, from catching under lower portions 42, 43 of the ring.

As it is clear from FIGS. 2–6, plate 56 is not hinged in a direction transverse to direction 62 inward from hole 64 to hole 66.

Figure 6:
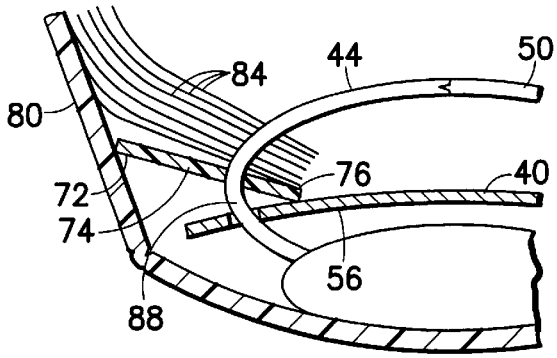
FIG. 6 is a schematic view of the positioner and ring of FIG. 3 with a sheet lifter and paper.

In FIG. 6, end 72 of sheet lifter 74 is cammed upward by folding up cover 80. End 76 of the sheet lifter is raised by plate 56 which was cammed upward by ring 50 when the ring was closed. Sheet lifter 74, raised by positioner 40 supports paper sheets 84 from being caught under the apex 88 of the elliptical curve segment 44 of binder ring 50.

Figure 7:
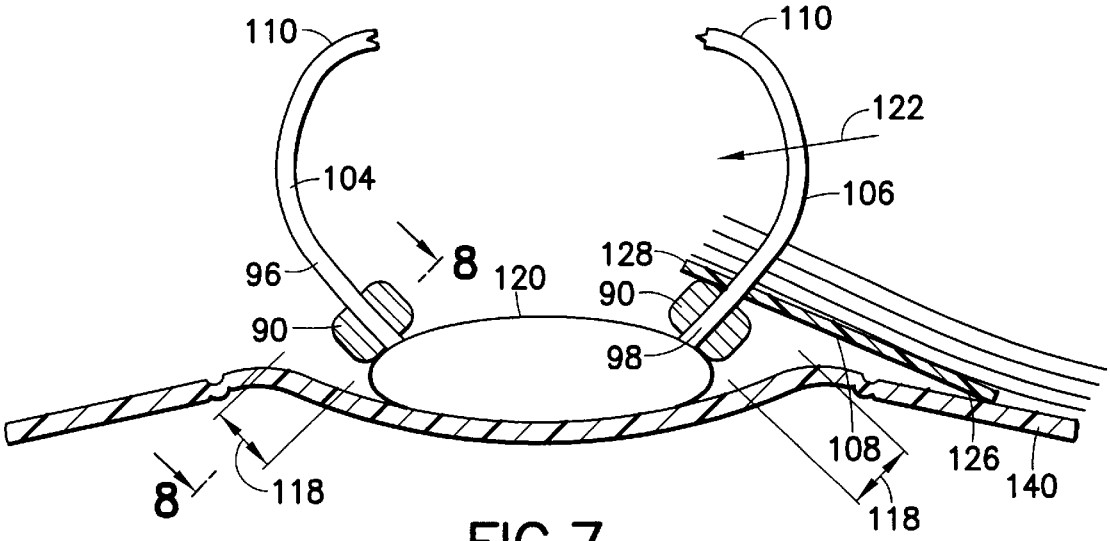
FIG. 7 is a schematic view of a positioner shown in cross section, mounted on an open circular ring of a ring binder.
Figure 8:
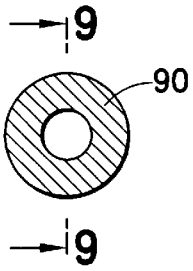
FIG. 8 is a top cross section view of the positioner of FIG. 7 taken along 8—8.
Figure 9:
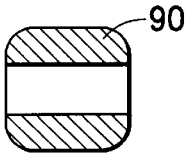
FIG. 9 is a front cross section view of the positioner of FIG. 8 taken along 9—9.

Referring to FIGS. 7–9, positioners 90 are mounted on lower portions 96, 98 of segments 104, 106 of ring 110. For explanatory purpose, only one sheet lifter, lifter 108, is shown. Positioner 90 spaces sheet lifter 108 from ring operating mechanism housing 120.

Positioner 90 spaces 118 end 128 of the sheet lifter from housing 120 while ring segment 106 is drawn inward 122 during closing of ring 110 and provides a raised pivot bead or short cylinder on the ring arm around which sheet lifter 108 rotates as end 126 of sheet lifter 108 is raised by cover 140 when the cover is closed.

Figure 11:
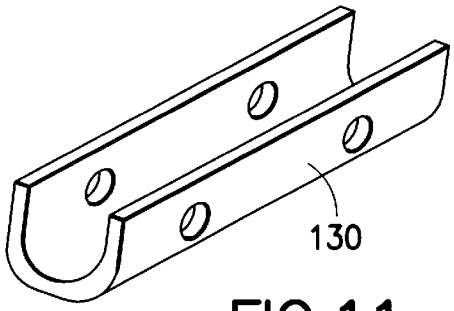
FIG. 11 is a perspective view of the positioner of FIG. 10.
Figure 10:
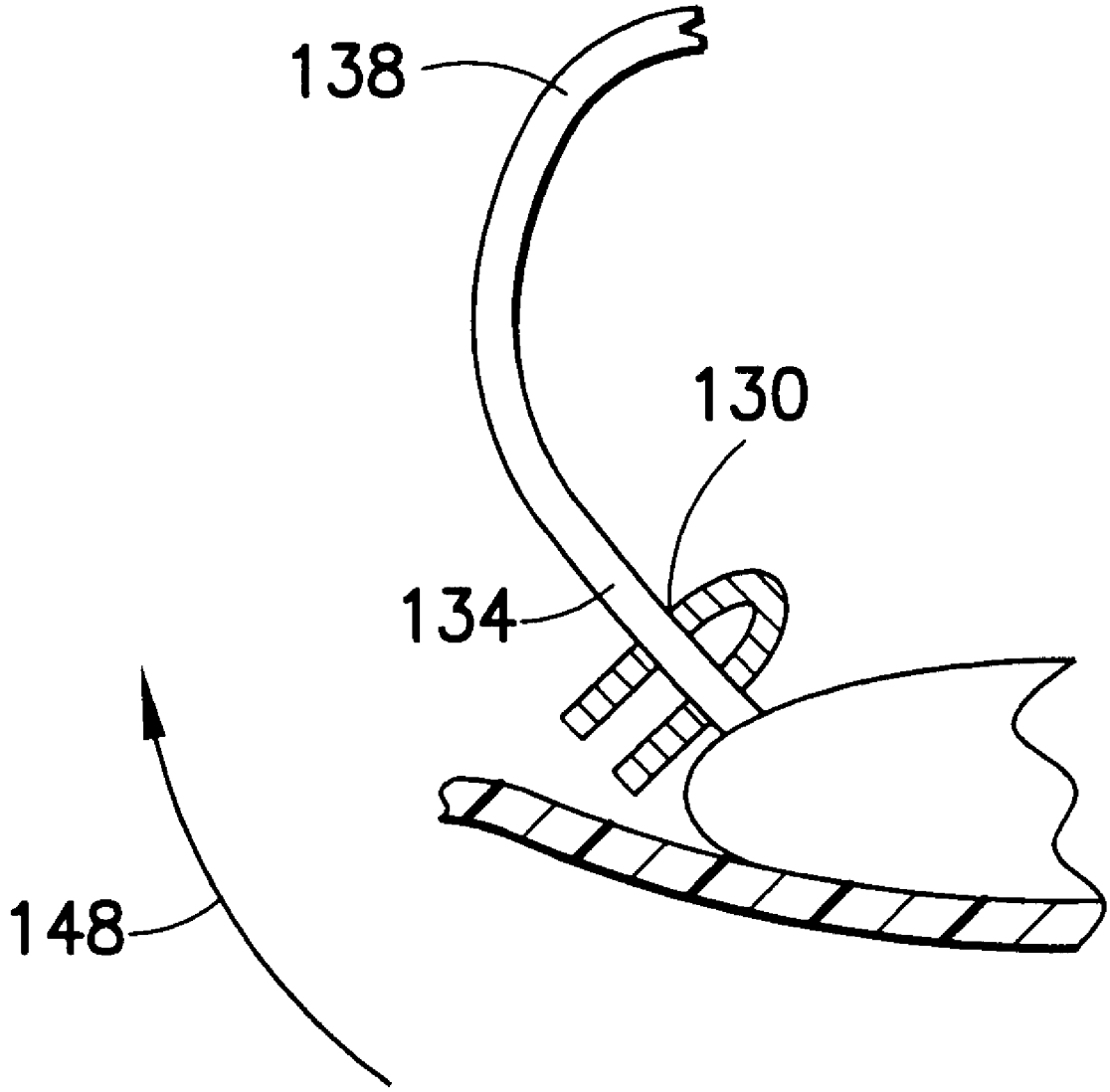
FIG. 10 is a schematic view of an positioner shown in cross section, mounted on an open circular ring of a binder.
Figure 12:
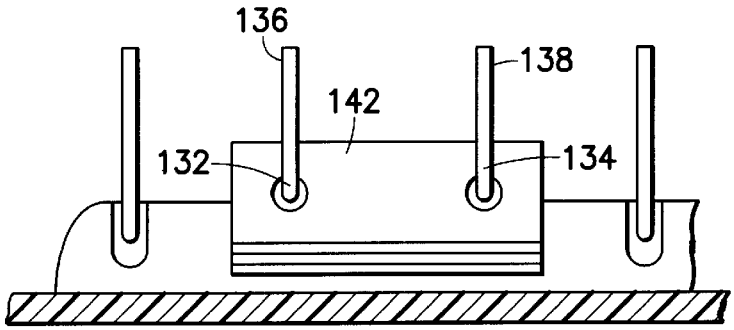
FIG. 12 is a schematic view of the positioner of FIG. 10 mounted on two rings of a multiple-ring binder.
Figure 13:
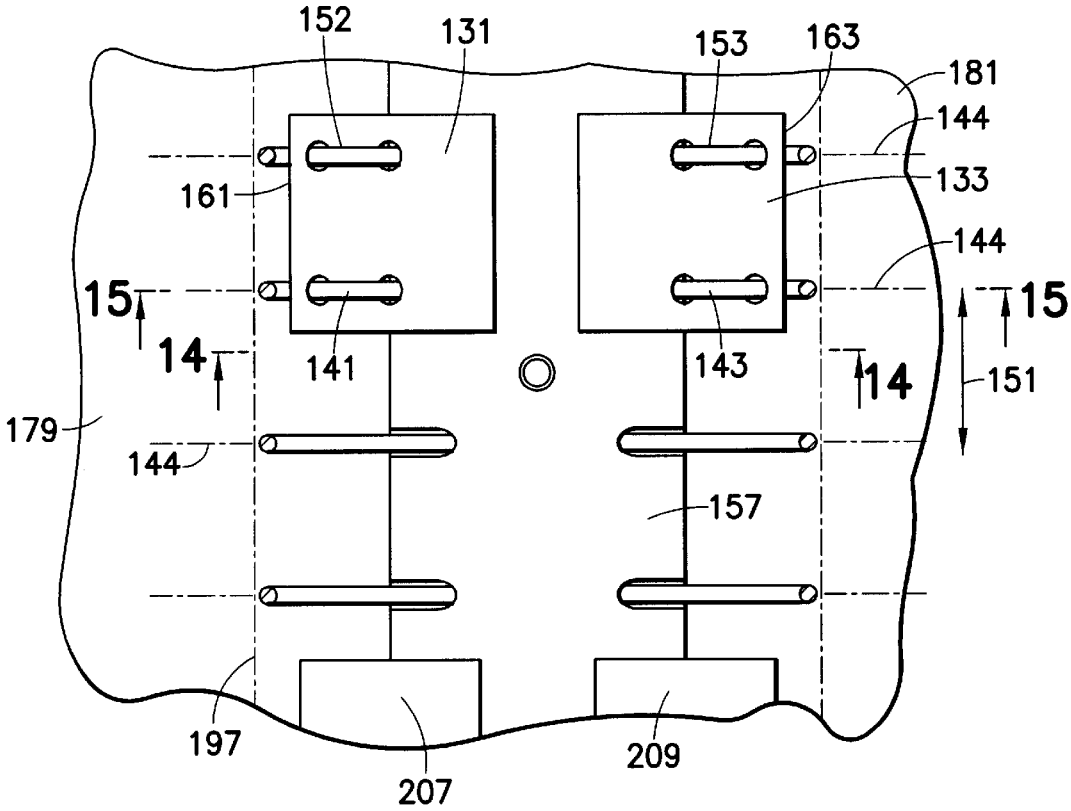
FIG. 13 is a top schematic top view of a trapezoidal ring, ring binder with two positioners of the invention installed on the rings.
Figure 14:
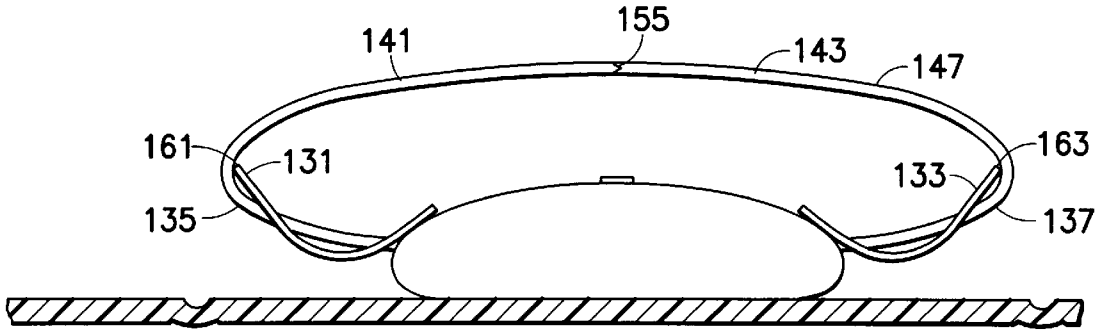
FIG. 14 is a schematic view of the positioners of FIG. 13 viewed along 14—14. The internal mechanism of the binder rings is not shown.
Figure 15:
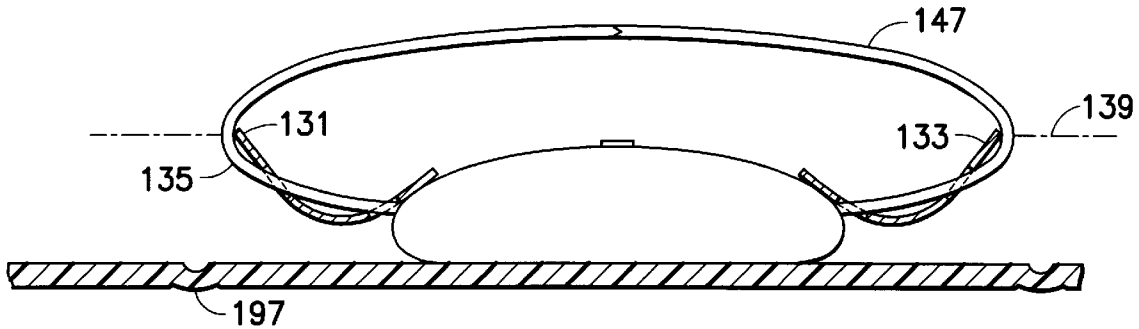
FIG. 15 is a schematic view of the positioners of FIG. 13 viewed along 15—15. The internal mechanism of the binder rings is not shown.
Figure 16:
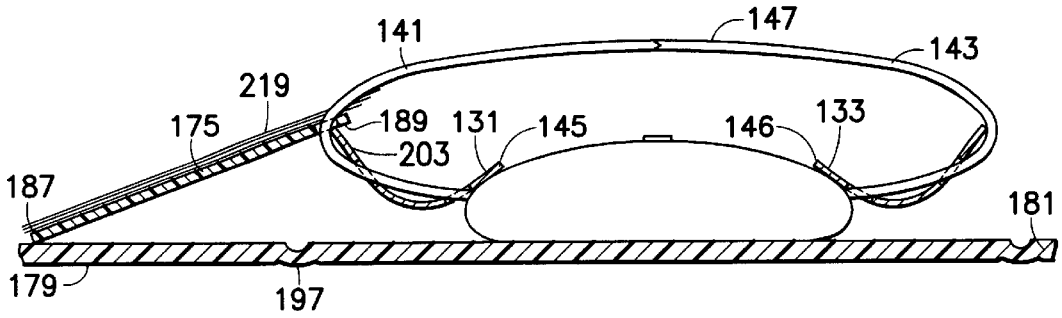
FIG. 16 is a schematic front view of a sheet lifter mounted on the ring, supported at one end by a positioner, the other end of the sheet lifter being supported by the cover of the binder.
Figure 17:
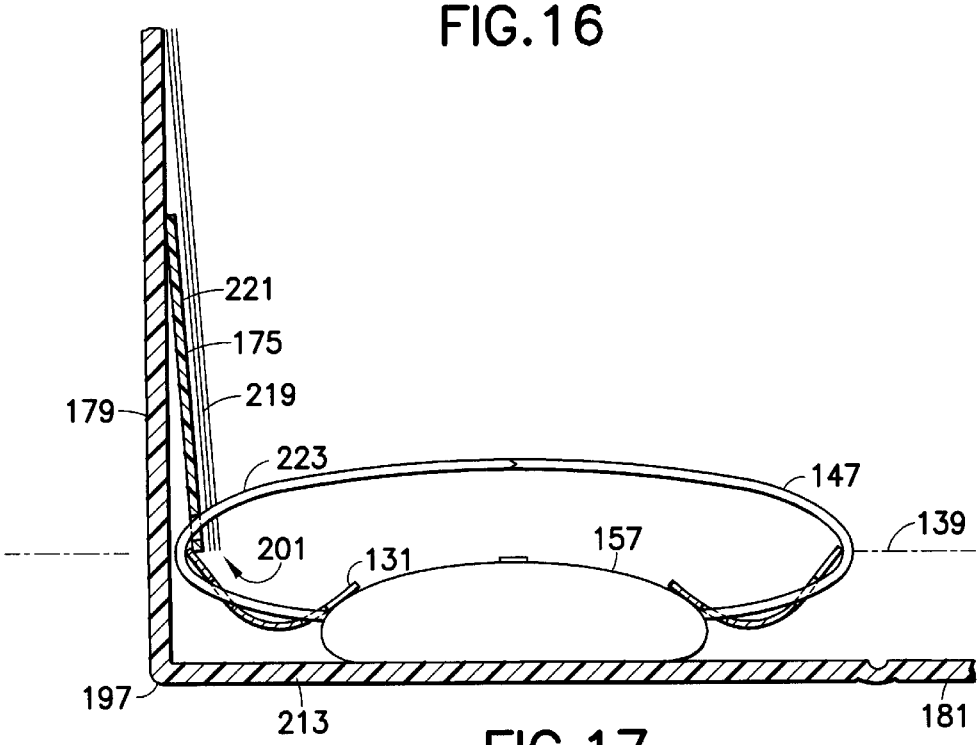
FIG. 17 is a schematic front view of the assembly of FIG. 16 with the cover folded up.

Referring to FIGS. 10–12, positioner 130 is mounted on lower portions 132, 134 of parallel round rings 136, 138 adjacent to housing 142. Positioner 130 is preferably elastic so that it resiliently grips the rings to prevent the positioner from moving upward 148 from vibration and handling of the loose-leaf book.

Positioner 130 spaces the end of a sheet comprising a loose-leaf sheet, sheet lifter, or both, from the ring operating mechanism housing. It provides a round pivot around which the inner portion of the sheet turns as a cover rotates and lifts the outward portion of the sheet.

Positioner 130 is mounted on the ring by squeezing the walls toward each other, sliding the positioner down on a segment of the ring until the positioner is on the lower portion of the segment and releasing the grip on the walls so that they can resile outward and grip the ring shaft.

Referring to FIGS. 13–17, postitioners 131, 133 are mounted on lower portions 135, 137 of segments 141, 143 of ring 147 and on lower portions of segments 152, 153 of the adjacent ring. Planes 144 of the rings are parallel.

Positioners 131, 133 are two of a plurality of positioners mounted on rings along length 151 of ring operating mechanism cover 157 on the spine of binder 181. Two more of the plurality of positioners are seen, at 207 and 209, in FIG. 13. The top ends 161, 163 of the positioners rest against the concave arc of the ring inside the ring, preferably at the lower portion of the ring. When the ring is closed, separable junction 155 is closed at the top of the ring. The positioners are resilient or springy so that they press forcefully against the inside and outside of the rings. Preferably end portions 145, 146 press against ring operating mechanism cover 157.

As it is clear from FIGS. 14–17, positioner 131 arcs from end portion 145 being in the ring adjacent to ring operating mechanism cover 157, to being outside the ring below line 139 that extends through a portion of the ring that exhibits a wide horizontal of closed ring, to top end 161 being in the ring above end portion 145.

When left cover 179 of binder 181 is opened to a generally flat position, end 189 of stiff plastic sheet lifter 175 rests on end 161 and end 187 of the lifter rests on cover 179 of binder 181.

As cover 179 is folded upward about hinge 197, end 187 is pushed upward by cover 179 and end 189 pivots downward around top end 161 of positioner 131, and is cammed upward 201 by portion 203 of positioner 131. This prevents sheet lifter 175 and papers 219 that are resting against surface 221 of sheet lifter 175 from sliding under lower portion 135 of the ring segment. Preferably positioner 133 extends high enough on the ring segment so that the sheet lifter rests on the positioner at the height at which a tangent to the curve is about vertical.

If there is no sheet lifter, the paper will rest like a sheet lifter, on end 161 of positioner 131. The positioner will prevent sliding of the paper under lower portion 135 of segment 141.

Preferably when the cover is moved to perpendicular with base 213, sheet lifter 175 is cammed by the positioner to move paper sheets 219 to top portion 223 of the ring so that neither the sheet lifter nor the paper on the sheet lifter is caught between the cover and the outer surface of the ring at or below the widest horizontal portion 139 or diameter of the closed ring.

Figure 18:
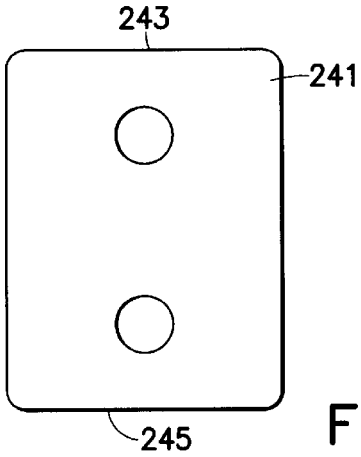
FIG. 18 is a schematic top view of another positioner.

In FIG. 18, 0.05 inch thick polypropylene positioner 241 is designed to be mounted on one ring, whereas positioner 131 is designed to be mounted on a pair of rings. Preferably positioner 241 is mounted on at least one segment of each of several rings, or all the rings, of a plurality of rings along the length of the ring binder mechanism. Positioner 241 can be mounted on a ring so that either end 243, or 245 is the top end. Preferably, its ends in the plane of the ring are positioned on the lower portion of the ring like the ends of positioner 241 is positioned on the plane of the ring.

Figure 19:
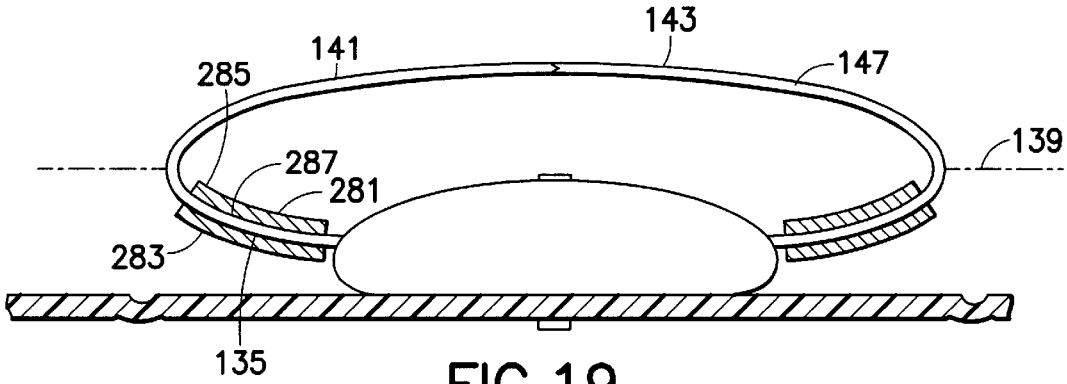
FIG. 19 is a schematic front view of a pair of tubular positioners mounted on the ring of a ring binder.

In FIG. 19, tube 281 of positioner 283 is mounted on lower portion 135. Tube 281 end 285 is preferably high enough on segment 141 so that the lower end of a sheet lifter will not be cammed past end 285 by the cover, so that the lower end of the sheet guide will not catch on end 285, preventing the sheet guide from sliding down over inner side 287 of positioner 283.

Figure 20:
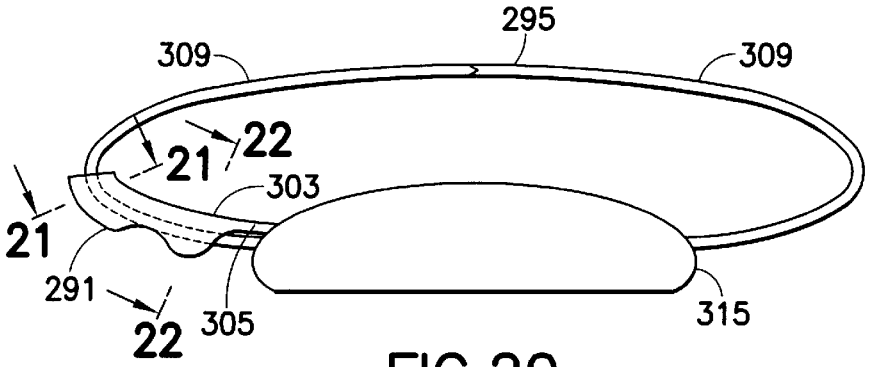
FIG. 20 is a schematic view of another positioner mounted on a binder ring.
Figure 21:
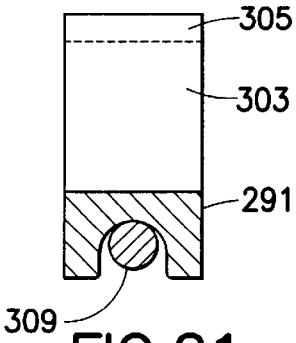
FIG. 21 is a cross section view of the positioner of FIG. 20, taken at 21—21.
Figure 22:
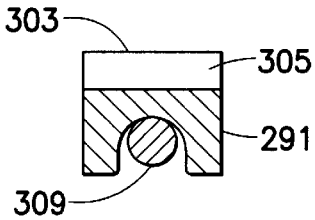
FIG. 22 is a cross section view of the positioner of FIG. 20, taken at 22—22.

Referring to FIGS. 20–22, positioner 291 snaps laterally onto rod 309 of ring 295. Positioner 291 is molded in one piece of plastic that is resilient enough to snap on the ring, preferably it can be snapped off the ring. The snap-on positioner tends to hold a position wherein smooth cam surface 303 is inside the curve of the positioner, facing radially inward. Extension 305 can be included. Extension 305 contacts ring mechanism cover or housing 315 wherein the extension provides resistance to rotation of positioner 291 around rod 309 of ring 295.

In another design the positioner can be reversibly snapped on the ring end for end.

Figure 23:
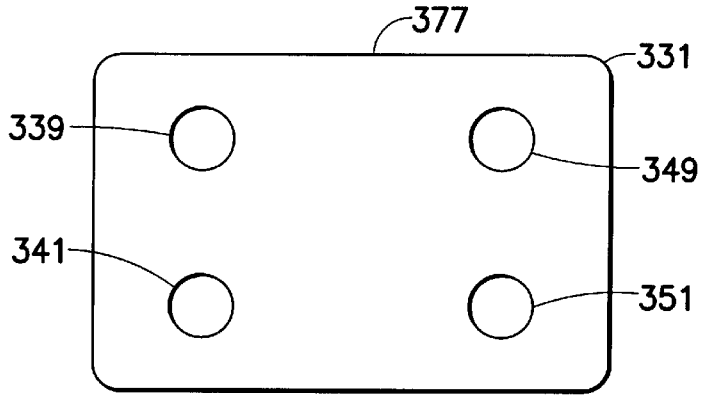
FIG. 23 is a schematic top view of another positioner of the invention.

In FIG. 23, positioner 331 is made of polypropylene. It is designed for use on two adjacent four inch rings. One of the pair of rings passes through holes 339 and 341, while the second ring passes through holes 349 and 351.

Figure 24:
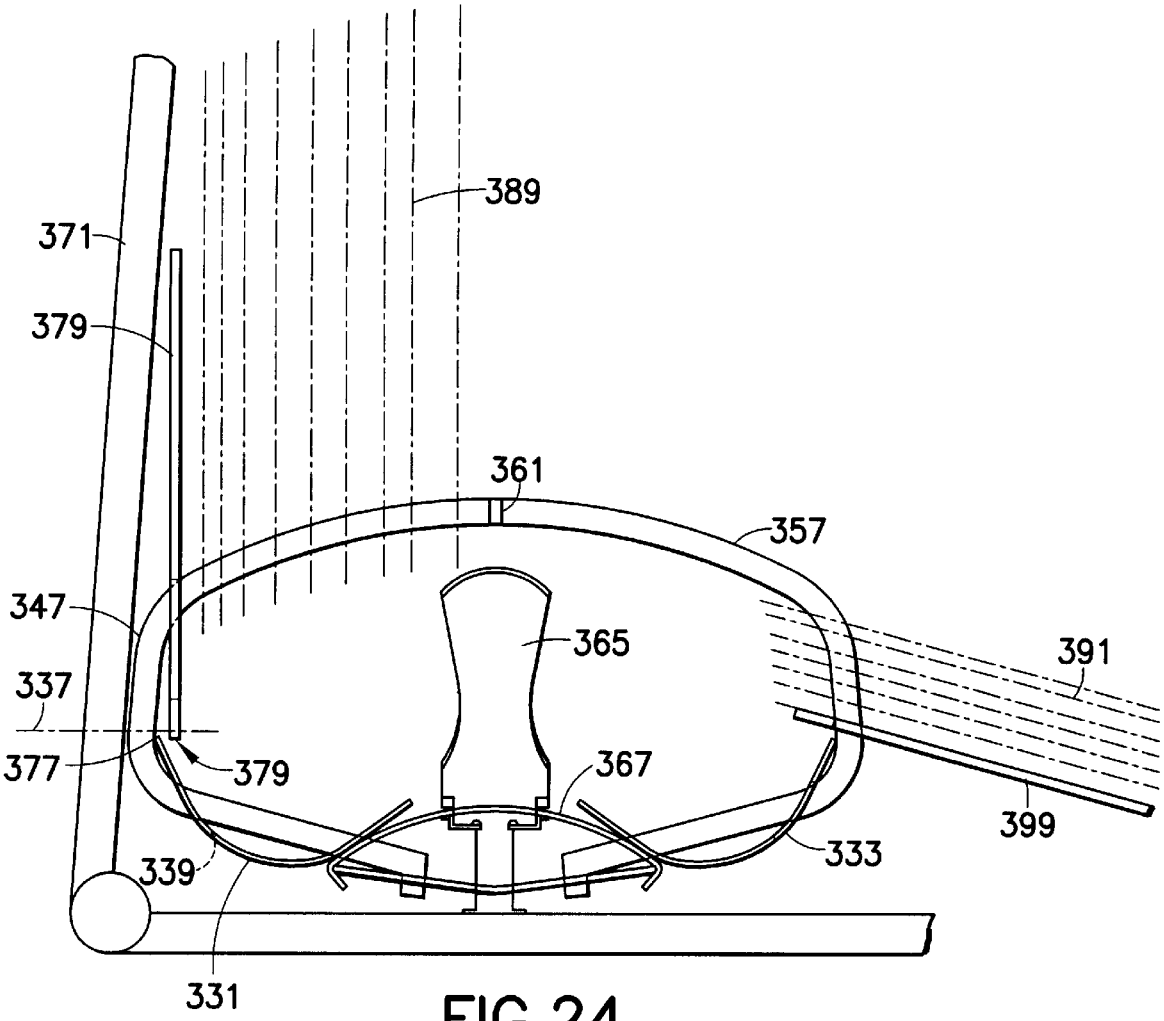
FIG. 24 is a schematic front view of the positioner of FIG. 23, a sheet lifter, and sheets of paper, mounted on a loose-leaf binder ring.

In FIG. 24, four inch ring 357 opens at junction 361 when pivoted open by thumb lever 365 by way of a pivot mechanism (not shown) in housing 367. Cover 371 is folded up, while the cover (not shown) on the other side of housing 367 is lying flat. Top 377 of positioner 331 is at the center line 337 of the lower bend of loop 341 of ring 357. Sheet lifter 379, after being slid up loop 347 and up positioner 331 by upward moving cover 371, is just below and adjacent to top end 377 of positioner 331, and adjacent to paper 389. Paper 391 rests on sheet lifter 399 which rests on positioner 333.

Positioners of the invention, made in appropriate size can be installed on spiral rings of a book so that the covers and end papers are not caught at the back of the spiral and wrapped around the sides of the spiral when the book is closed. The positioners of the invention may take other shapes including but not limited to bar, tube, and longitudinal folded strip, with transverse holes for mounting on parallel rings.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A loose-leaf binder ring assembly comprising a first arcuate segment, a second arcuate segment movable away from said first arcuate segment for opening said ring for receiving a sheet on one of the first and second segments by a hole in the sheet, and movable toward said first arcuate segment for closing said ring at a first junction, a ring operating mechanism cover from which lower portions of the first and second segments protrude, a tube having a top, a bottom and a longitudinal opening through which said tube is mounted on a segment, mounted on at least one of the first and second segments between the cover and a line in a plane of the ring that extends through a portion of the ring exhibiting a wide horizontal of closed ring.

2. The loose-leaf binder of claim 1 in which the top of said tube is toward and spaced from said line when said ring is closed.

3. The loose-leaf binder of claim 1 in which the top of said tube is approximately tangent to said line.

4. The loose-leaf binder of claim 1 in which said longitudinal opening extends laterally through a side of said tube, said tube being mountable on said ring by moving said tube laterally on to a segment through said opening.

5. The loose-leaf binder of claim 1 in which the top of the tube is on said line.

6. The loose-leaf binder of claim 2 wherein the top of said tube is curved downward and outward.

7. The loose-leaf binder of claim 2 further comprising:

a sheet mounted on the ring by a hole through the sheet, wherein the top of the tube is curved downward and outward to a diameter that is larger than said hole.

8. A sheet positioner for supporting a sheet on a sheet binder ring assembly comprising a first arcuate segment, a second arcuate segment movable away from the first arcuate segment for opening a first ring for receiving a sheet on one of the first and second segments by a hole in the sheet, and movable toward the first arcuate segment for closing the ring at a first junction, a second ring parallel to and spaced from the first ring, comprising a third segment, a ring operating mechanism cover having a length, from which lower portions of the first, second and third segments protrude, a first line in a plane of the first ring that extends through a portion of the ring exhibiting a wide horizontal of closed ring, said sheet positioner comprising:

a first longitudinal wall, a second longitudinal wall, a third wall connecting said first wall to said second wall forming a longitudinal channel, a first hole through said first wall, a second hole through said second wall, an axis through the first and second holes that is transverse to said channel, each hole of the first and second holes being large enough to receive a segment of the first ring, said channel being elastic so that said first and second walls resile laterally so that said channel locks on the segment by said first and second holes when said channel is left unattended mounted on the segment.

9. The sheet positioner of claim 8 wherein said third wall and the connection of said third wall to the first and second walls is hingeless.

10. The sheet positioner of claim 9 wherein said channel is mounted on a segment of the ring spaced from and below said first line.

11. A sheet positioner assembly for a sheet binder comprising:

a first binder ring comprising a first arcuate segment, a second arcuate segment movable away from said first arcuate segment for opening said first ring for receiving a sheet on one of the first and second segments by a hole in the sheet, and movable toward said first arcuate segment for closing said ring at a first junction, a second ring parallel to and spaced from said first ring, comprising a third segment, a ring operating mechanism cover having a length, from which lower portions of the first, second and third segments protrude, a first line in a plane of said first ring that extends through a portion of the ring that exhibits a wide horizontal of closed ring, a first longitudinal wall, a second longitudinal wall, a third wall connecting said first wall to said second wall forming a longitudinal channel, a first hole through said first wall, a second hole through said second wall, an axis through the first and second holes that is transverse to the longitudinal axis of said channel, each hole of the first and second holes being large enough to receive a segment of said first ring, said channel being on one of the first and second segments, said channel being elastic so that said first and second walls resile laterally so that said channel locks on the segment by said first and second holes when said channel is left unattended.

12. The sheet positioner assembly of claim 11 further comprising:

said channel extending across the first and second rings, third and fourth holes in the first and third walls, receiving a segment of said second ring.

13. The sheet positioner assembly of claim 11 wherein said third wall and the connection of said third wall to the first and second walls is hingeless.

14. A sheet positioner for supporting a sheet on a sheet binder ring comprising a binder cover, a first arcuate segment and a second arcuate segment movable away from the first arcuate segment for opening the ring for receiving a sheet on one of the first and second segments by a hole in the sheet, and movable toward the first arcuate segment for closing the ring at a first junction, a ring operating mechanism cover from which lower portions of the first and second segments protrude, a binder cover hingedly connected to the ring operating mechanism cover, said sheet positioner comprising:

a panel having a length, a first end, a second end, and comprising a first hole through said panel, a second hole through said panel spaced from said first hole, the spacing of the holes from each other and the length being such that when said panel is mounted on one of the lower portions through the first and second holes and the ring is closed, said panel arcs from said first end being in the ring adjacent to said operating mechanism cover, to being outside the ring below a line in a plane of the ring that extends through a portion of the ring that exhibits a wide horizontal of closed ring, to said second end being in the ring above said first end for pivoting a sheet on said second end when the sheet is mounted on the ring on said panel and the sheet is moved toward the junction by the binder cover.

15. A loose-leaf binder ring assembly comprising a first arcuate segment and a second arcuate segment movable away from said first arcuate segment for opening said ring for receiving a sheet on one of the first and second segments by a hole in the sheet, and movable toward said first arcuate segment for closing said ring at a first junction, a ring operating mechanism cover from which lower portions of the first and second segments protrude, a binder cover hingedly connected to said ring operating mechanism cover, a panel having a first end and a second end, comprising a first hole through said panel, a second hole through said panel, mounted on one of the lower portions through the holes so that when said ring is closed, said panel arcs from said first end being in said ring adjacent to said operating mechanism cover, to being outside said ring below a line in a plane of said ring that extends through a portion of said ring that exhibits a wide horizontal of closed ring, to said second end being in said ring above said first end for pivoting a sheet on said second end when the sheet is mounted on said ring on said panel and the sheet is moved toward said junction by said binder cover.

16. The assembly of claim 15 wherein said second end is adjacent to said line.

17. The assembly of claim 15 wherein said second end is on said line.

* * * * *